United States Patent [19]

Mitchell et al.

[11] 4,005,295

[45] Jan. 25, 1977

[54] COMPONENT CONTAINER

[76] Inventors: James P. Mitchell, 5412 W. Henderson St.; Henry J. Lakoma, 5347 W. School St., both of, Chicago, Ill. 60641

[22] Filed: Nov. 17, 1975

[21] Appl. No.: 632,464

[52] U.S. Cl. ..... 200/61.62; 200/61.82; 220/307

[51] Int. Cl.[2] ..... H01H 3/16

[58] Field of Search ..... 220/306, 307; 335/205; 200/61.62, 62.81, 61.7, 294, 295, 296

[56] References Cited

UNITED STATES PATENTS

| | | | |
|---|---|---|---|
| 3,532,372 | 10/1970 | Stroud | 220/307 |
| 3,890,476 | 6/1975 | Canter et al. | 335/205 X |

*Primary Examiner*—George T. Hall
*Attorney, Agent, or Firm*—Anthony S. Zummer

[57] ABSTRACT

A component container having a vessel portion and a cap is herein disclosed. A base forms part of the vessel portion. The base is connected to a substantially cylindrical housing. The cylindrical housing has an inside taper, an outside taper and a central axis. A plurality of wedge shaped tines is uniformly distributed around the outside of the cylindrical housing. The tines are aligned substantially parallel to the central axis. The cap is a snap fit cap having a pair of opposed slots and is selectively connectable to the cylindrical housing opposite the base. The snap fit cap has a plurality of spring tabs which extend from the cap into the interior of the cylindrical housing when the cap is fitted to the vessel portion. Either a magnetic reed switch or a bar type magnet may be held within the component container.

9 Claims, 8 Drawing Figures

COMPONENT CONTAINER

BACKGROUND OF THE INVENTION

Magnetically controlled switches are old in the art. Likewise magnetically controlled burglar alarms are old in the art.

Magnetic switches are often used in applications where the separation of a magnet and a reed switch will cause the reed switch to close, thus triggering an alarm. A typical example of this type of system involves a magnet embedded in a door and a reed switch connected to a suitable alarm system embedded in the door jamb immediately opposite the magnet when the door is closed. Most doors and accompanying door jambs are made of wood. Another example involves a magnet embedded in a wooden window frame and an accompanying reed switch embedded in the wooden window track. It is therefore desirable to provide a container construction which may be quickly and easily embedded in the wood. It is also desirable to provide a container construction which is firmly embedded in the wood after its first insertion so that it will not jar loose or fall out when the door is being opened or closed.

It is desirable that a single container construction be used for a variety of applications and to hold a variety of electrical components. It is also desirable that the container construction be of a low cost and easily fabricated.

SUMMARY OF THE INVENTION

The instant invention relates to a component container having a vessel portion and a cap. A base forms part of the vessel portion. A substantially cylindrical housing having an inside taper, an outside taper and a central axis is connected to the base. A plurality of wedge shaped tines, aligned substantially parallel to the central axis, are formed integral with the outside of the cylindrical housing. The cap, which is a snap fit cap compressionally engages one end of the substantially cylindrical housing opposite the base. In use, a magnetic reed switch is connected to a pair of metal tabs which penetrate the cap. The metal tabs are adapted for electrical connection to an alarm circuit. Also likewise, in use, a bar, cylinder or rod magnet can be fitted inside the substantially cylindrical housing. The cap is then fitted on top of the cylindrical housing to secure the bar magnet within the cylindrical housing.

It is a principal object of the present invention to provide a component container which is lockingly embeddable in wood or other fibrous materials.

It is a further object of the instant invention to provide a component container which is adapted to hold either an electrical reed switch or a bar magnet.

It is still another object of the present invention to provide a component container which may be easily and economically produced.

DESCRIPTION OF THE PREFERRED EMBODIMENT

Figures 1, 2, 3, 4, 5, 6, 7, 8:
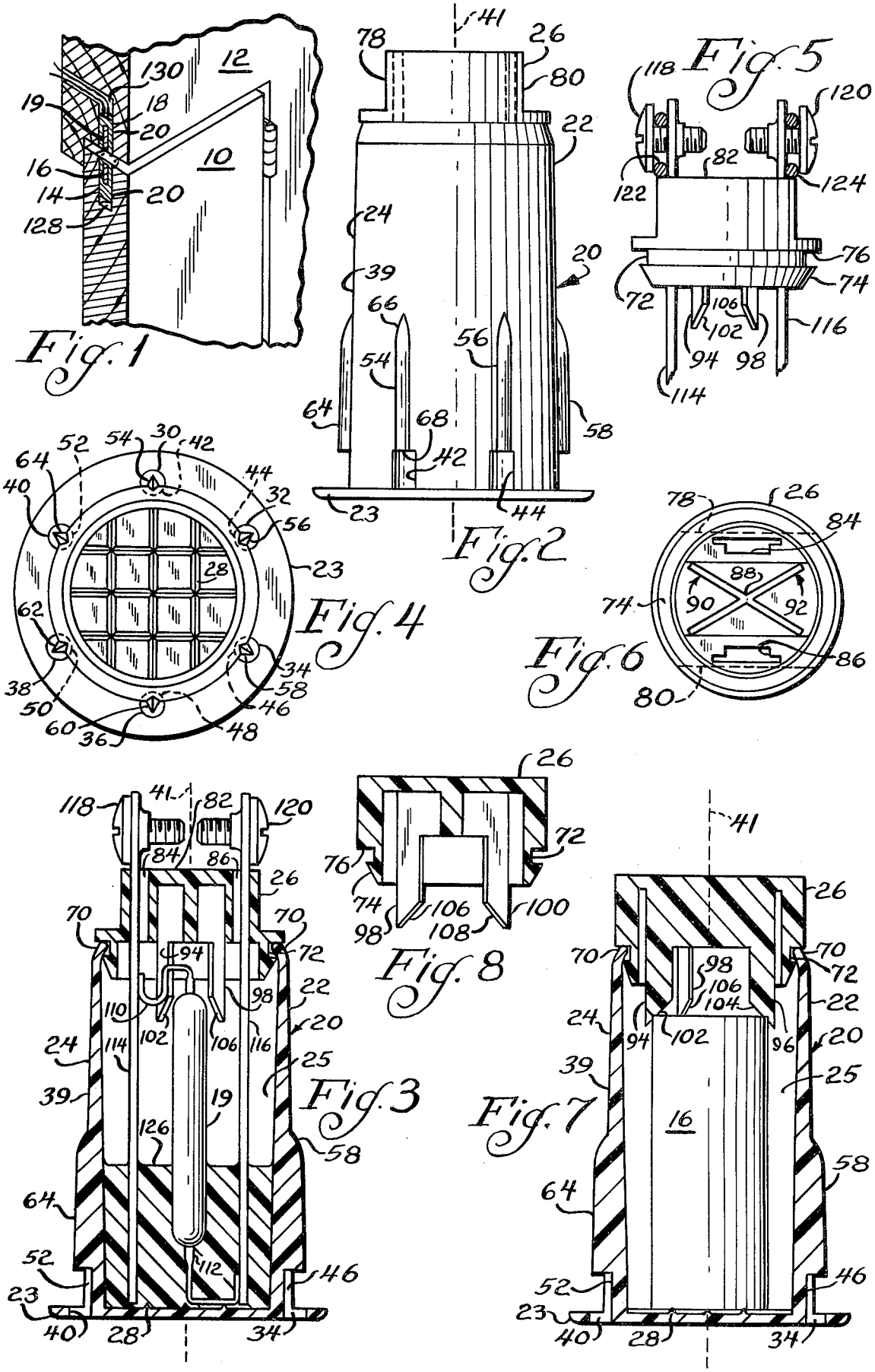
FIG. 1 is a sectional view of a portion of a wooden door and accompanying door jamb showing details as to how the component containers are embedded within the door and the door jamb.
FIG. 2 is a side view of the component container.
FIG. 3 is a sectional view of the component container of FIG. 2 showing in addition, the construction of the component container and an accompanying reed switch electrically connected to a pair of metal tabs.
FIG. 4 is a top view of the cylindrical housing and the base of the component container of FIG. 2 with the cap removed.
FIG. 5 is a side view of the cap of FIG. 2 further including details showing the positioning of the metal tabs and their accompanying electrical connections as shown in FIG. 3.
FIG. 6 is a bottom view of the cap of FIG. 2.
FIG. 7 is a side sectional view of the component container of FIG. 2 further including a bar magnet held between the base and the spring tabs of the cap of the component container.
FIG. 8 is a cut-away view of the cap of FIGS. 2 and 6.

Referring now to the drawings, and especially to FIGS. 1 and 2, a door 10 and its accompanying door jamb 12 are shown therein. Door 10 has a component container 14, having a bar magnet 16 therein, embedded within door 10. Door jamb 12 has a component container 18 having a reed switch 19 therein, embedded therein. Both component containers 14 and 18 are identical and are in fact identical to an exemplary component container 20, as shown in FIG. 2. Component container 20 includes a vessel portion 22. A circular base 23 comprises part of vessel portion 22. A substantially cylindrical housing 24, having a central bore 25, is formed integral with and perpendicular to base 23. A cap 26 cooperatively engages the upper part of vessel portion 22.

Base 23, as stated above, is a circular base. Base 23 has a square grid 28 having a triangular grid form molded into base 23. A plurality of apertures 30, 32, 34, 36, 38 and 40 perforates base 23 at equal distances, immediately adjacent the periphery cylindrical housing 24.

Component container 20, is substantially circular in cross-section and has an outside wall 39 tapered from base 23 to cap 26. Cylindrical housing 24 has an inside taper from cap 26 to base 23. Cylindrical housing 24 has a central axis of symmetry 41. A plurality of short arc-like channels 42, 44, 46, 48, 50 and 52 is formed immediately adjacent apertures 30, 32, 34, 36, 38 and 40 respectively. A plurality of wedge shaped tines 54, 56, 58, 60, 62 and 64 is formed integral with the outside of cylindrical housing 24 and immediately adjacent arc-like channels 42, 44, 46, 48, 50 and 52. Tines 54, 56, 58, 60, 62 and 64 are aligned substantially parallel to central axis 41. Wedge shaped tine 54 has a front tapered portion 66 and a perpendicular back edge 68, immediately adjacent channel 42. Wedge shaped tines 56, 58, 60, 62 and 64 have an identical construction to wedge shaped tine 54. Wedge shaped tines 54, 56, 58, 60, 62 and 64 comprise a means for holding vessel portion 22 in an aperture. Cylindrical housing 24 ends in a turned-in lip 70. Lip 70 engages a rim 72 of cap 26. The bottom portion of rim 72 is formed by a triangular shoulder 74. An upper portion of rim 72 is formed by a widened flat shoulder 76.

Cap 26 is of a generally circular configuration, however, cap 26 has a pair of straight sides 78 and 80 and a shelf 82. Immediately adjacent straight sides 78 is a T-shaped slot 84. Immediately adjacent straight side 80 is a T-shaped slot 86. T-shaped slots 84 and 86 penetrate the length of cap 26.

A cross bar 88, having a pair of cross legs 90 and 92 is formed integral with the underside of cap 26. A plurality of spring tabs 94, 96, 98 and 100 is respectively formed integral with cross bar 88. Spring tabs 94, 96, 98 and 100 each has a respective triangular edge 102, 104, 106 and 108. Spring tabs 94, 96, 98 and 100 all extend an equal distance beyond triangular shoulder 74. That is, spring tabs 94, 96, 98 and 100 extend into central bore 25 of cylindrical housing 24 when cap 26 is snapped to vessel portion 22. 19

Component container 20 is adapted to hold a variety of electrical and electronic components such as reed switch 19 or bar magnet 16. In the reed switch configuration, reed switch 19 has a lead 110 and a lead 112 which are soldered respectively to a pair of metal tabs 114 and 116 which extend from above cap 26, through T-slots 78 and 80, all the way down to circular base 23. A pair of machine screws 118 and 120 is opposingly threaded through metal tabs 114 and 116. A pair of wires 122 and 124 is respectively connected to metal tabs 114 and 116 by machine screws 118 and 120. The distance between the edge of the heads of machine screws 118 and 120 and shelf 82 of cap 26 is smaller than the diameter of wires 122 and 124. Thus wires 122 and 124 are positively held between shelf 32 and machine screws 118 and 120 respectively.

Furthermore when a reed switch such as reed switch 19 is employed it is often desirable to fixedly position the reed switch within central bore 25. Therefore an epoxy resin 126 is poured into the central bore 25 after reed switch 19 and metal tabs 112 and 114 are introduced thereto. Epoxy resin 126 hardens and engages triangular grid work 28 in addition to metal tabs 114 and 116 and reed switch 19 thereby immobilizing reed switch 29 within central bore 25.

A bar, cylinder or rod magnet such as bar magnet 16 may also be positioned within central bore 25 of component container 20. Different diameter bar magnets may be used inside component container 20. The triangular edges 102, 104, 106 and 108 of spring tabs 94, 96, 98 and 100 enable the spring tabs to adjust themselves to varying diameters and lengths of bar, rod or cylinder magnets and to engage compressionally the magnets. Bar magnet 16 likewise, compressionally engages triangular grid work 28 to hold bar magnet 16 in position.

After container 20 has been loaded with a reed switch 19 or a bar magnet 16 the container is ready for embedding in a door or door jamb or other piece of wood. An aperture 128 having approximately the same diameter as cylindrical housing 24 is bored in door 10. Component container 20 is then pushed or lightly tapped into aperture 128. Wedge shaped tines 54, 56, 58, 60, 62 and 64 force the wood fibers apart as component container 20 penetrates aperture 128. Once component container 20 has been seated with base 23 against the door edge, the wood fibers of door 10 have a tendency to spring back and fill in underneath the perpendicular back edges of tines 54, 56, 58, 60, 62 and 64 thus holding component container 20 securely in place without using any extraneous fasteners. Likewise, component container 20 may also be introduced into door jamb 12 by insertion into an aperture 130. The wedge shaped tines also grip and hold component container 20 within aperture 130.

Therefore, it may be appreciated that component container 20 provides an economical method of mounting reed switches and bar magnets.

It is also apparent that a single container construction, as is disclosed herein, can be used interchangeable to either hold reed switches or bar magnets, as needed.

Likewise, it is also apparent that the construction of the present invention provides a component container having a plurality of tines which lickingly engage with wood fibers when the component container is introduced into a piece of wood, thereby effectively holding the component container without the necessity of using screws, nails or other extra fasteners.

Although a specific embodiment of the herein disclosed invention has been described in detail above it may be appreciated that those skilled in the art may make other modifications and changes in the specific switch container disclosed above without departing from the spirit and scope of the present invention. It is to be expressly understood that the instant invention is limited only by the appended claims.

What is claimed is:

1. A component container comprising: a vessel portion, said vessel portion having a plurality of rigid tines connected to an outside wall of said vessel portion, said vessel portion holding an electrical component; and a cap, engaging said vessel portion.

2. A component container as defined in claim 1, in which said vessel portion includes a substantially right circular cylindrical housing, said substantially right circular cylindrical housing having a bore, said bore holding said electrical component, said substantially right circular cylindrical housing having an axis.

3. A component container as defined in claim 3, in which each rigid tine of said plurality is a wedge-shaped tine, each rigid tine of said plurality is aligned substantially parallel to said axis, and each rigid tine of said plurality is formed integral with said outside wall of said substantially right circular cylindrical housing.

4. A component container as defined in claim 3, in which said substantially right circular cylindrical housing is connected to a base, said substantially right circular cylindrical housing having an edge positioned at an obtuse angle with respect to a wall of said substantially right circular cylindrical housing opposite said base, and said cap has a circumferential rim adapted for a releasable snap connection to said edge of said substantially right circular cylindrical housing, said cap releasably sealingly closing said substantially right circular cylindrical housing.

5. A component container as defined in claim 1, in which said cap includes a plurality of elongated cantilever leaf spring tabs, said plurality of elongated cantilever leaf spring tabs extending into a bore of said vessel portion when said cap engages said vessel portion, said plurality of elongated cantilever leaf spring tabs engaging said electrical component.

6. A component container as defined in claim 1, in which said vessel portion further includes a grid work, said grid work engaging said electrical component.

7. A component container comprising: a circular base, said circular base having a grid work formed integral therewith, said grid work being adapted for engagement with an electrical component; a substantially cylindrical housing, said substantially cylindrical housing being formed integral with and perpendicular to said circular base, said substantially cylindrical housing having a central axis, said substantially cylindrical housing having a tapered central bore, said tapered central bore being adapted to hold said electrical component, said substantially cylindrical housing having a tapered outside wall, said substantially cylindrical housing having a turned-in edge opposite said circular base; a plurality of wedge shaped tines, each tine of said plurality being formed integral with said outside wall and substantially parallel to said central axis, each tine of said plurality having a wedge portion and a perpendicular back edge, each tine of said plurality being adapted for holding engagement with a fibrous material; and a cap, said cap having a circumferential rim adapted for snap connection with said turned-in edge of said substantially cylindrical housing, said cap having a pair of slots, each slot of said pair being adapted to hold an electrical connector, said cap having a plurality of spring tabs formed integral therewith, said plurality of spring tabs being adapted to extend into said tapered central bore when said cap is connected to said substantially cylindrical housing.

8. A component container as defined in claim 7 in which said electrical component is a reed switch.

9. A component container as defined in claim 7 in which said electrical component is a bar magnet and said plurality of spring tabs engage said bar magnet.

* * * * *

UNITED STATES PATENT OFFICE

CERTIFICATE OF CORRECTION

PATENT NO. : 4,005,295

DATED : January 25, 1977

INVENTOR(S) : James P. Mitchell and Henry J. Lakoma

It is certified that error appears in the above-identified patent and that said Letters Patent are hereby corrected as shown below:

Column 3, Line 8, cancel "19".

Column 3, Line 34, "29" should be --19--.

Signed and Sealed this

Twelfth Day of April 1977

[SEAL]

*Attest:*

RUTH C. MASON
*Attesting Officer*

C. MARSHALL DANN
*Commissioner of Patents and Trademarks*